United States Patent [19]

Simone

[11] 4,216,074

[45] Aug. 5, 1980

[54] DUAL DELAYED COKING OF COAL LIQUEFACTION PRODUCT

[75] Inventor: Andre A. Simone, Denville, N.J.

[73] Assignee: The Lummus Company, Bloomfield, N.J.

[21] Appl. No.: 938,222

[22] Filed: Aug. 30, 1978

[51] Int. Cl.[2] ..... C10G 1/00; C10G 1/06; C10G 9/14

[52] U.S. Cl. ..... 208/8 LE; 208/10; 208/131

[58] Field of Search ..... 208/8 LE, 10, 131

[56] References Cited

U.S. PATENT DOCUMENTS

| | | | |
|---|---|---|---|
| 3,563,884 | 2/1971 | Bloomer et al. | 208/131 X |
| 3,617,515 | 11/1971 | Bloomer | 208/131 |
| 3,856,675 | 12/1974 | Sze et al. | 208/8 |
| 3,966,585 | 6/1976 | Gray et al. | 208/131 X |
| 4,039,424 | 8/1977 | Hyde et al. | 208/8 LE |
| 4,075,079 | 2/1978 | Lang | 208/8 LE |
| 4,101,413 | 7/1978 | Jones et al. | 208/131 X |
| 4,116,815 | 9/1978 | Sunojo et al. | 208/131 X |

FOREIGN PATENT DOCUMENTS

| | | | |
|---|---|---|---|
| 2735257 | 9/1978 | Fed. Rep. of Germany | 208/8 LE |

*Primary Examiner*—Delbert E. Gantz
*Assistant Examiner*—William G. Wright
*Attorney, Agent, or Firm*—Louis E. Marn; Elliot M. Olstein

[57] ABSTRACT

Coal which is liquefied in the presence of a pasting solvent, is separated into an ash free and an ash containing coal liquefaction product. Each of such products is delayed coked in separate zones with the vapors from such zones being introduced into a common combination coker-fractionator to recover ash containing and ash free coking recycle, pasting solvent for the liquefaction and lighter products. The process is particulary applicable to coal liquefaction products produced from high ash containing coals.

8 Claims, 1 Drawing Figure

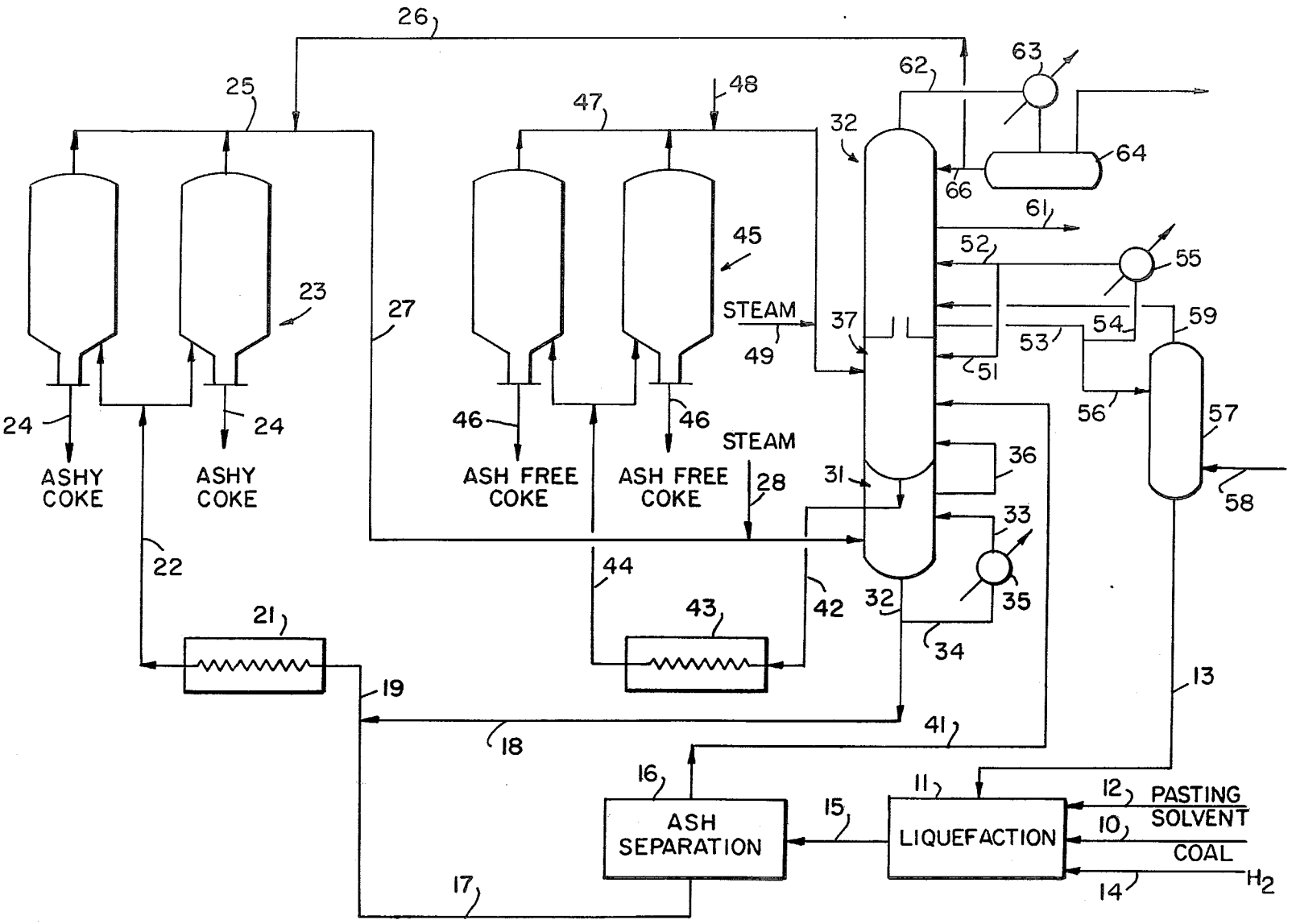
PASTING SOLVENT
COAL
$H_2$
LIQUEFACTION
ASH SEPARATION
STEAM
STEAM
ASH FREE COKE
ASH FREE COKE
ASHY COKE
ASHY COKE

DUAL DELAYED COKING OF COAL LIQUEFACTION PRODUCT

This invention relates to the liquefaction of coal, and more particularly to the production of coke from a coal liquefaction product.

In accordance with the present invention, there is provided an improvement in a process for the liquefaction of coal wherein coal is liquefied in the presence of a coal liquefaction solvent and the liquefied coal is separated into an ash free coal liquefaction product and an ash containing coal liquefaction product by effecting delayed coking of the ash containing coal liquefaction product in a first delayed coking zone to produce an ash containing coke, and effecting delayed coking of the ash free coal liquefaction product in a second delayed coking zone to produce an ash free coke. Vapors from the first delayed coking zone are introduced into a separate section of a coker combination fractionator where a coking recycle which can contain ashy coke carried over from the first coking zone is separated from the vapors for recycle to the first delayed coking zone. Vapors from the first section and vapors from the second delayed coking zone are introduced into the main portion of the coker combination fractionator wherein there is recovered an ash free coking recycle for the second delayed coking zone, recycle pasting solvent for the liquefaction of coal, and lighter components.

The present invention will be further described with respect to an embodiment thereof illustrated in the accompanying drawing, wherein:

The drawing is a simplified schematic flow diagram of an embodiment of the present invention.

It is to be understood, however, that the scope of the invention is not to be limited thereby. It is further to be understood that various equipment such as valves, pumps and the like have been omitted in order to simplify description of the embodiment.

Referring now to the drawing, ground or pulverized coal, preferably bituminous coal, in line 10 is introduced into a coal liquefaction zone, schematically indicated as 11, along with makeup coal liquefaction solvent in line 12 and recycle pasting or coal liquefaction solvent, in line 13, obtained as hereinafter described. The coal liquefaction solvent may be any one of a wide variety of coal liquefaction solvents used in the art, including both hydrogen donor solvents, non-hydrogen donor solvents and mixtures thereof. These solvents are well known in the art and, accordingly, no detailed description thereof is deemed necessary for full understanding of the invention. In general, such liquefaction should have an initial boiling point of at least 350° F., with the 95 volume percent boiling point generally not exceeding 900° F. As particularly described, the coal liquefaction solvent boils within the range of from 550° F.-600° F. to 850° F.-900° F. The solvent is added to the coal in an amount sufficient to effect the desired slurry viscosity in the paste preheating section as well as proper flow characteristics for efficient coal conversion in the liquefaction zone. In general, the coal liquefaction solvent is added in an amount to provide a solvent to coal weight ratio from about 1:1 to about 20:1, and preferably, from about 1.5:1 to about 5:1.

In the coal liquefaction zone 11, the coal is effectively slurried in the pasting solvent and liquefied as known in the art. The liquefaction may be catalytic or non-catalytic, and may be effected in the presence or absence of added hydrogen, preferably in the presence of hydrogen added through line 14. The hydrogenation may be effected in a fixed catalyst bed, fluidized catalyst bed or an expanded or ebullating bed. The details of the coal liquefaction step form no part of the present invention and, accordingly, no details thereof are required for a full understanding of the present invention.

A coal liquefaction product comprised of a liquid coal extract of dissolved carbonaceous matter in the coal liquefaction solvent and insoluble material (ash and undissolved coal) is withdrawn from the liquefaction zone 11 through line 15 and introduced into an ash separation zone, schematically generally indicated as 16. In the ash separation zone 16, the coal liquefaction product is separated into afirst liquefied coal fraction, which is essentially free of ash and solid materials, and a second liquefied coal fraction which contains the ash and unconverted coal. Each of such fractions also includes the coal liquefaction solvent. The quantity of paste solvent in the first and second liquefaction products depends on the solids separation technique employed.

The separation of the coal liquefaction product into an ash free and an ash containing fraction may be effected in any one of a wide variety of ways which are generally known in the art. Such separation is preferably effected as disclosed in U.S. Pat. No. 3,856,675, which is hereby incorporated by reference. In accordance with such procedure, such separation is effected by the use of liquid promoter which enhances and promotes the separation of insoluble material.

An ash containing coal liquefaction product is withdrawn from the ash separation zone 16 through line 17, and in the case where such separation is effected by the use of a promoter liquid, such promoter liquid has been previously separated from the coal liquefaction product. The ash containing coal liquefaction product in line 17 is combined with ash containing coking recycle in line 18, obtained as hereinafter described, and the combined stream in line 19 introduced into a coking heater 21, of a type known in the art. The coking heater is operated so as to produce an outlet temperature of from about 850° F. to about 950° F. The coking heater 21 is operated as generally known in the art to prevent premature coking therein; i.e., the feed is maintained in turbulent motion or at a high velocity by providing temperature and pressure profiles in the heater that will produce partial vaporization of the feed, thereby preventing the coking problems caused by slow moving feed in the liquid state. In addition, controlled amounts of steam may be introduced into the coking heater to obtain the required turbulence or high velocity.

The heated stream in line 22 is introduced into one of two delayed coking drums, schematically generally indicated as 23 to effect coking of the heavier components to produce an ash containing coke. As known in the art, such coke drums are generally operated in a block-out type of operation, with one coke drum being on-stream, and the other being subjected to coke removal. In general, the coking drums 23 are operated at a pressure of from about 15 psig to about 125 psig, and an overhead temperature of from about 800° F. to about 900° F. Ash containing coke, which can be used as a gasification feedstock to produce, for example, a carbon monoxide/hydrogen-rich syn gas, from which hydrogen for liquefaction can be made, is withdrawn from the coke drums 23 through suitable coke removal lines 24.

Coke drum vapors are withdrawn from drums 23 through line 25, and such vapors are cooled by direct contact quenching with a cold coker naphtha stream in line 26, obtained as hereinafter described, with such quenching cooling the vapors to a temperature in the order of from about 740° F. to about 840° F. The vapors are quenched immediately after leaving the coke drum in order to minimize coke formation in the vapor transfer lines. The quenched vapors in line 27 are further combined with steam in line 28, with such steam also being employed to minimize coking by reducing hydrocarbon partial pressure. The main function of the steam, however, is to lower the partial pressure in the coker combination tower to permit recovery of the coal liquefaction solvent, as hereinafter described, at suitable temperatures. The coke drum overhead vapors withdrawn from the ash containing coke drums 23 are then introduced into a lower wash section 31 of a coker combination fractionator, schematically generally indicated as 32. The wash section 31 is employed to remove high ash content coke particles which are entrained in the vapors, with such separation being effected by direct contact with a wash liquid introduced into the wash section 31 through line 33. Condensed liquid, containing ash, is withdrawn from section 31 through line 32, and such condensate is passed through line 18 as a coking recycle. A further portion thereof is passed through line 34, including a suitable cooler 35, for recycle as wash liquid through line 33.

Vapors from the lower section 31 are passed through line 36 into the main portion 37 of the coker combination fractionator 32 for treatment as hereinafter described. It is to be understood that such separation could be effected in a vessel separate from the fractionator.

Ash free coal liquefaction product is withdrawn from ash separation zone 16 through line 41, with such ash free coal liquefaction product containing coal liquefaction solvent, and in the case where a promoter liquid is employed for effecting separation of ash, such product is free of such promoter liquid. The ash free coal liquefaction product in line 41 is introduced into the bottom of the main portion 37 of the coker combination fractionator 32 to effect flashing of materials boiling below the initial boiling point of the coking feedstock. In general, the tower is operated to effect recovery of a coking feedstock having an initial boiling point of at least 600° F. As particularly described, the initial boiling point is above the end point of the coal liquefaction solvent, i.e., above 850° F. to 900° F.

Coking feed, along with recycle, obtained as hereinafter described, is withdrawn from the main section 37 of the coker combination fractionator tower 32 through line 42 and introduced into a coking heater 43, of a type known in the art, wherein the ash free coking feedstock is heated to an outlet temperature of from about 850° F. to about 950° F. The coking heater 43 is operated in a manner similar to coking heater 21 in order to prevent premature coking.

Heated coking feed is withdrawn from heater 43 through line 44 and introduced into one of a pair of delayed coking drums 45 for producing an ash free coke. As described with reference to the coking drums 23, the coking drums 45 are operated in a block out type arrangement, with one drum being on-stream, and the other drum being de-coked. Ash free coke is recovered from the drums 45 through lines 46. The coke drums are operated at an overhead temperature of from 800° F. to 900° F. and a pressure of from 15 psig to 125 psig.

Coke drum vapors are withdrawn from coke drums 45 through line 47 and are cooled by direct contact quenching with a cold coker naphtha stream in line 48, obtained as hereinafter described, to effect cooling thereof to a temperature in the order of from about 740° F. to about 840° F. The coke vapors are further combined with steam in line 49 and introduced into the main portion of the coker combination tower 32. The quenching with coker naphtha in line 48 and the steam addition through line 49 is effected for the reasons hereinabove described with respect to the delayed coking vapors from drum 23.

The coker combination fractionator is generally operated at an overhead temperature of from about 250° F. to about 350° F., a bottoms chimney temperature of from about 600° F. to about 800° F. and a pressure of from about 5 psig to about 115 psig. Vapor from the coke drum 45 as well as vapor introduced from the lower section 31 through line 36 are contacted in the lower section of the coker combination tower 32 with reflux introduced through line 51, obtained as hereinafter described, to effect condensation of coking recycle, which is recycled to the coking heater 43 along with the fresh feed, through line 42.

Vapors flow from the lower section through the chimney of the tower and are then contacted with reflux introduced through line 52 in order to effect condensation of a heavy oil cut for recycle as coal liquefaction solvent. As particularly described, such coal liquefaction solvent has an initial boiling point of from about 550° F. to about 600° F., and an end point in the order of from about 850° F. to about 900° F. It is to be understood, however, that the coal liquefaction solvent, as known in the art, can have an initial boiling point and/or end point other than as described with respect to the embodiment. Such coal liquefaction solvent cut is withdrawn from the coker combination tower 32 through line 53 and a first portion thereof passed through line 54 including a cooler 55 for use as reflux in lines 51 and 52. The cooler which is schematically indicated as 55 is a schematic representation of several heat exchangers which are employed to effect cooling of the reflux stream while providing heating of other streams in the overall process.

The remaining portion in line 56 is introduced into a coal liquefaction solvent stripper schematically generally indicated as 57 wherein the stream is stripped with steam introduced into line 58. The stripper 57 is generally operated at a temperature in the order of from about 710° F. to about 740° F., and at a pressure substantially the same as that for the combination tower in order to separate lighter boiling front end constituents. The stripped components are introduced into the coker combination tower 32 through line 59.

The stripped coal liquefaction solvent is recycled to the coal liquefaction through line 13.

The coker combination fractionator 32 is also operated to recover a light gas oil side stream, generally a stream boiling within the range from about 340° F. to about 600° F., which is withdrawn through line 61. Vapors leaving the top of tower 32 through line 62 are partially condensed by cooler 63 in order to provide reflux to the top of the tower and a quench stream for the coke drum overhead vapors. A vapor stream, containing coker off gas and naphtha, is withdrawn from an overhead accumulator drum 64 through line 65, with condensed liquid being employed as reflux to the tower in line 66, and as quench liquid in lines 26 and 48.

Although the invention has been described with respect to a specific embodiment thereof, it is to be understood that such embodiment may be modified within the spirit and scope of the present invention. As a result, the invention is not limited to the hereinabove described embodiment.

The present invention is particularly applicable to the liquefaction of coals having a high ash and/or unreactive coal content in the order of from 10 to 40 weight percent. In accordance with the present invention, it is possible to effectively utilize the ash containing coal liquefaction product by the application of delayed coking which maximizes recovery of valuable liquids from this stream. This eliminates the loss of valuable liquid components which can not be effectively separated from such stream simply by distillation in that in such distillation, there is a need to have sufficient liquid present with the solids leaving the bottoms of the fractionator to insure flowability of the liquid/solids mixture.

In accordance with the present invention, it is possible to produce two grades of coke, using a common coker fractionator, which is also utilized to recover the liquefaction solvent contained in both the ash containing and ash free coal liquefaction product streams.

These and other advantages should be apparent to those skilled in the art from the teachings herein.

Numerous modifications and variations of the present invention are possible in light of the above teachings and, therefore within the scope of the appended claims, the invention may be practised otherwise than as particularly described.

I claim:

1. In a process for the liquefaction of coal wherein coal is liquefied in the presence of a coal liquefaction solvent and the liquefied coal is separated into an ash free coal liquefaction product and an ash containing coal liquefaction product, the improvement comprising:

effecting delayed coking of ash containing coal liquefaction product in a first delayed coking zone to produce an ash containing coke and a first vapor;

effecting delayed coking of ash free coal liquefaction product in a second delayed coking zone to produce an ash free coke and a second vapor;

condensing from the first vapor a first liquid recycle, said first liquid recycle containing ash;

introducing said first liquid recycle into the first delayed coking zone;

introducing first vapor remaining after condensing of said first liquid recycle into a main combination fractionator wherein there is recovered a second liquid recycle, said second liquid recycle being free of ash, a coal liquefaction solvent and lighter components;

passing second liquid recycle to the second delayed coking zone; and passing coal liquefaction solvent to the liquefaction of coal.

2. The process of claim 1 wherein the delayed coking in the first and second delayed coking zones is effected at an overhead temperature of from about 800° F. to about 900° F. and a pressure of from about 15 psig to 125 psig.

3. The process of claim 1 wherein the coal employed in the liquefaction has an ash and unreacted coal content of from 10 to 40 wt. percent.

4. The process of claim 2 wherein the coal liquefaction solvent recovered in the coker combination fractionation boils within the range of from 550° F.–600° F. to 850° F.–900° F.

5. The process of claim 2 wherein a portion of the first liquid recycle is cooled and employed as a wash liquid to condense first liquid recycle from the first vapor.

6. The process of claim 4 wherein the first and second vapor are each cooled prior to separating of the first and second liquid recycle by direct contact quenching with a portion of the lighter components recovered from the coker combination fractionator.

7. The process of claim 8 wherein the coker combination fractionator is operated at an overhead temperature of from about 250° F. to about 350° F., a bottoms chimney temperature of from about 600° F. to about 800° F. and a pressure of from 5 psig to 115 psig.

8. The process of claim 6 wherein ash free coal liquefaction product is introduced into the coker combination fractionator prior to introduction thereof into the second delayed coking zone to thereby recover lower boiling components therefrom.

* * * * *